United States Patent [19]

Yamaguchi

[11] 4,437,380

[45] Mar. 20, 1984

[54] MUSICAL ENVELOPE-PRODUCING DEVICE

[75] Inventor: Tetsuo Yamaguchi, Kawasaki, Japan

[73] Assignee: Tokyo Shibaura Denki Kabushiki Kaisha, Kawasaki, Japan

[21] Appl. No.: 331,077

[22] Filed: Dec. 15, 1981

[30] Foreign Application Priority Data

Dec. 17, 1980 [JP] Japan ..... 55-178424

[51] Int. Cl.[3] ..... G10H 1/02

[52] U.S. Cl. ..... 84/1.26; 84/1.03; 368/272

[58] Field of Search ..... 84/1.03, 1.26, 1.01, 84/1.13; 368/272

[56] References Cited

U.S. PATENT DOCUMENTS

| | | | |
|---|---|---|---|
| 3,854,365 | 12/1974 | Tomisawa et al. | 84/1.01 |
| 4,090,349 | 5/1978 | Takase | 368/156 |
| 4,186,642 | 2/1980 | Gross | 84/1.26 |
| 4,201,109 | 5/1980 | Kitagawa | 84/1.26 |
| 4,267,586 | 5/1981 | Uchino et al. | 84/1.03 |
| 4,328,731 | 5/1982 | Gotho et al. | 84/1.03 |
| 4,355,559 | 10/1982 | Uya et al. | 84/1.03 |
| 4,368,989 | 1/1983 | Kawashima | 84/1.03 |

FOREIGN PATENT DOCUMENTS

| | | |
|---|---|---|
| 55-76973 | 6/1980 | Japan . |
| 55-76974 | 6/1980 | Japan . |
| 55-106381 | 8/1980 | Japan . |

*Primary Examiner*—Forester W. Isen

*Attorney, Agent, or Firm*—Finnegan, Henderson, Farabow, Garrett & Dunner

[57] ABSTRACT

Disclosed is a musical envelope-producing device which may be employed for an electronic watch with a melody performance function. The musical envelope-producing device has a memory which stores musical performance data representing pitches and durations of notes; an address counter; a pitch divider which generates a frequency signal corresponding to the pitch data; a note control circuit which divides a duration corresponding to the duration data into eight time components and generates a predetermined division signal when the duration has elapsed; and an envelope circuit which produces a sound pressure signal which is sequentially attenuated in a stepped manner in response to the division signal and which synthesizes the sound pressure signal and the frequency signal.

10 Claims, 8 Drawing Figures

MUSICAL ENVELOPE-PRODUCING DEVICE

BACKGROUND OF THE INVENTION

The present invention relates to a musical envelope-producing device and, more particularly, to a musical envelope-producing device which is employed for an electronic watch to perform melody sounds at a predetermined time and which adds an envelope characteristic to the melody sounds.

Recently, digital electronic watches which play various melodies instead of a monotonous alarm sound at predetermined times have been commercially available. These digital electronic watches display the time digitally, and a desired time may be set by the user. A conventional electronic watch with a melody function comprises a memory circuit for storing pitch data and duration data of a melody, a pitch frequency divider and a duration frequency divider which respectively produce a pitch signal and a duration signal according to the pitch data and the duration data, an address counter for specifying a memory address of melody sound data which is stored in the memory circuit, and a speaker means for converting an electric signal to a sound signal, in addition to a known time circuit. An impedance circuit corresponding to an envelope waveform producing unit is further provided for improving the tone quality of a melody sound produced by a conventional electronic watch to be as real as possible. The impedance circuit, for example, is constituted by a parallel circuit of a capacitor and a resistor. The potential of a melody signal is controlled in accordance with a time constant determined by the capacitance of a capacitor C and the resistance of a resistor R. A continuity characteristic is added to the melody signal so that a melody sound having the desired envelope characteristic is produced.

However, in an electronic watch having an impedance circuit which functions as the conventional envelope-producing device described above, a continuity characteristic is only accomplished in a manner which independent of the duration of various notes. The time constant of the impedance circuit is fixed and an envelope characteristic in accordance with this time constant is added to the original melody sounds. In other words, a single continuity characteristic is utilized. As a result, the conventional envelope-producing device is inadequate in that an envelope characteristic particularly directed to the performance tempo of melody sounds may not be accomplished. For example, when short notes such as the thirty-second note or the sixteenth note are consecutively performed, the next sound is generated before the current sound has been sufficiently attenuated. Therefore, the distinction between the two sounds becomes unclear. On the other hand, when long sounds such as whole notes are consecutively performed, the tone is attenuated before the duration of the note reaches a predetermined length, giving the listener an artificial impression. Furthermore, since time constants of CR components vary, the musical envelope characteristic accordingly varies.

SUMMARY OF THE INVENTION

It is an object of the present invention to provide a musical envelope-producing device which produces an optimal musical envelope characteristic corresponding to the duration of a note to be performed and which provides a melody performance similar to a natural performance attained with musical instruments.

According to the present invention, there is provided a musical envelope control device having memory means for storing at predetermined addresses a plurality of data note. The data for each note includes first and second musical performance data respectively representing the pitch and duration of a note. Connected to the memory means is read-out means which selects a predetermined note information by sequentially specifying addresses of the note information stored in the memory means, and reads out the selected note information in accordance with a predetermined time sequence. First and second processing means are further connected to the memory means. The first processing means receives first musical performance data (to be referred to as first data hereinafter) which is included in the note data read out from the memory means, and generates a frequency signal in response to the first data. The second processing means receives second musical performance data (second data) of the note information, and divides the duration of this note into a plurality of time components or division signals corresponding to the time division processing. Furthermore, the second processing means generates a predetermined detection signal when the duration of the note has elapsed to cause the data on the next note in the melody to be read out of the memory. An envelope circuit means is connected to the first and second processing means. The envelope circuit means receives the frequency signals and the division signal, and produces a sound pressure signal which is gradually attenuated in a stepped manner in response to the division signal, and is representative of the musical envelope waveform.

DETAILED DESCRIPTION OF THE PREFERRED EMBODIMENTS

Figure 1:
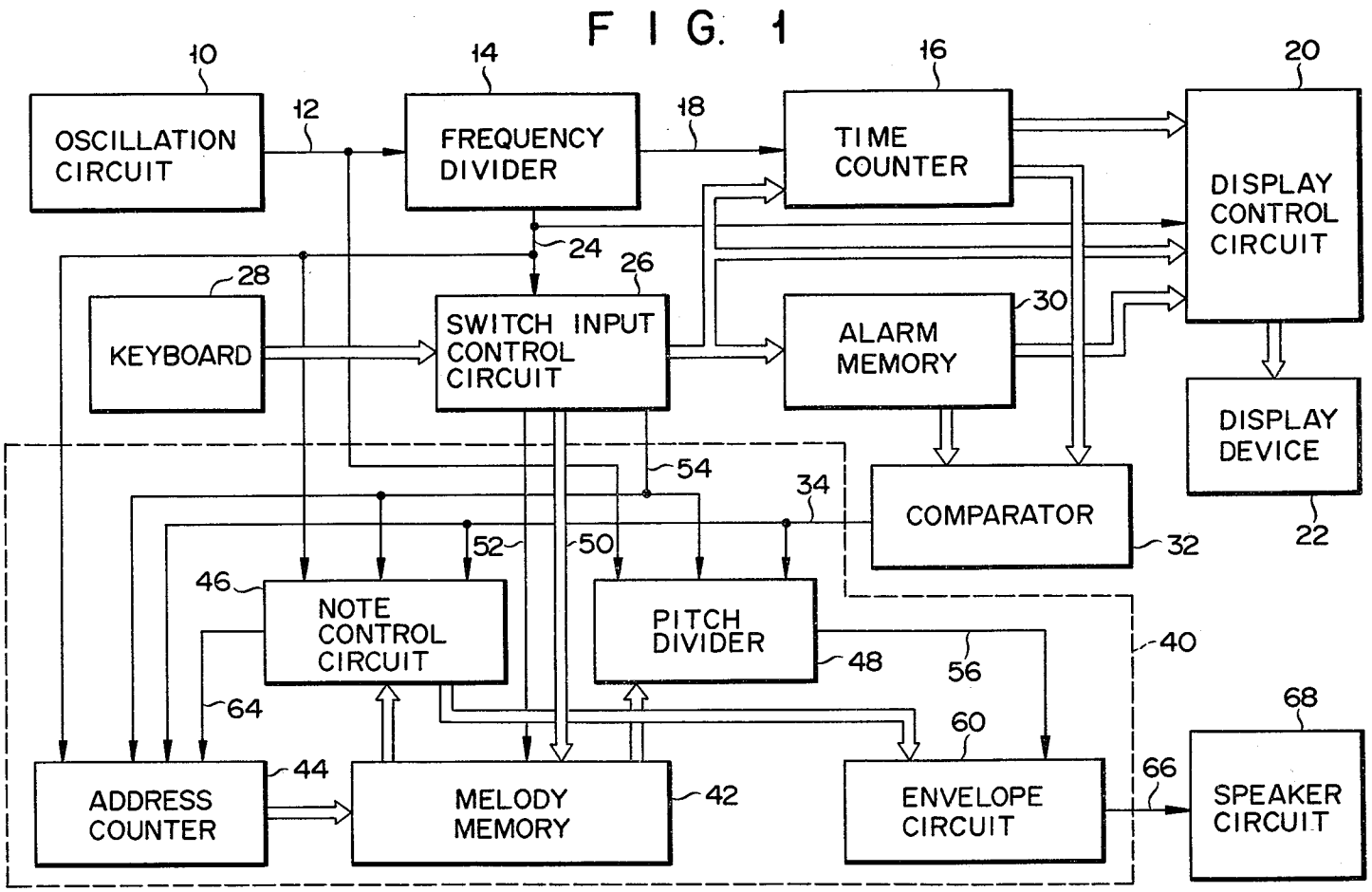
FIG. 1 is a schematic view illustrating the overall arrangement of an electronic watch with a melody alarm function according to one embodiment of the present invention.

FIG. 1 is a block diagram for illustrating the overall arrangement of an electronic watch with a melody alarm function according to one embodiment of the present invention. Reference numeral 10 denotes an oscillation circuit. The oscillation circuit 10 is arranged to include, for example, a quartz resonator (not shown) and generates a time reference signal 12 of a predetermined frequency, for example, about 32 kHz. An output end of the oscillation circuit 10 is connected through a frequency divider 14 to a time counter 16. The time reference signal 12 is frequency-divided at the frequency divider 14 and is then converted to a time clock signal 18 which is supplied to the time counter 16. The time counter 16 frequency-divides the time clock signal 18 into time units of second, minute and hour, and generates time data. This data is supplied to a display control circuit 20. The display control circuit 20 includes a known arrangement of a decoder (not shown), a display selector (not shown), a driver (not shown) and so on. The display control circuit 20 is connected to a display device 22 which is constituted by, for example, a liquid crystal display (LCD). The time data is digitally and visibly displayed on the display device in numbers designating time.

A frequency dividing signal 24 from a specified dividing step of the frequency divider 14 is supplied as a system control signal to the display control circuit 20, a switch input control circuit 26, an address counter 44 and a note control circuit 46. An input end of the switch input control circuit 26 is connected to an input section, for example, a keyboard 28. An output end of the switch input control circuit 26 is connected to the time counter 16, the display control circuit 20 and an alarm memory 30 which stores an alarm time. In response to the signal from the keyboard 28, the switch input control circuit 26 instructs correction of the time data generated by the time counter 16, instructs an alarm time setting for the alarm memory 30, specifies the display mode of the display device 22, and controls the alarm sound. Alarm time data set by an operator with the keyboard 28 is stored in the alarm memory 30, is transmitted to the display device 22 through the display control circuit 20, and is visually displayed at the display device 22. Output ends of the time counter 16 and the alarm memory 30 are connected to a comparator 32. The comparator 32 compares time data which is transmitted from the time counter 16 and which corresponds to the current time, and alarm time data which is transmitted from the alarm memory 30. When the time data of the time counter 16 coincides with the alarm time data, the comparator 32 detects this coincidence and generates a predetermined detection signal 34. The detection signal 34 is supplied to a melody control unit 40.

The melody control unit 40 includes a melody memory 42, the address counter 44, the note control circuit 46 and a pitch divider 48. The melody memory 42 is constitued by, for example, a known random acess memory. Stored in the memory 42 are musical performance data representing pitches of notes (to be referred to as pitch data hereinafter) and musical performance data indicating durations of notes (to be referred to as duration data hereinafter) which form a predetermined number of pieces of note information, each of which has a tone name. The melody memory 42 is connected through a data bus 50 to the switch input control circuit 26 which is connected to the keyboard 28. A read/write signal 52 is supplied from the switch input control circuit 26 to the melody memory 42. The duration data and the pitch data can be inputted to the melody memory 42 in response to an operation with the keyboard 28. When the operator sets predetemined duration and pitch data with the keyboard 28, these data are supplied to the melody memory 42 through the data bus 50 and are stored in the melody memory 42. When musical performance is made with the keyboard 28, the switch input control circuit 26 generates a start-up signal 54 which is supplied to the address counter 44, the note control circuit 46 and the pitch divider 48.

On the other hand, the detection signal 34 generated by the comparator 32 is supplied to the address counter 44, the note control circuit 46 and the pitch divider 48. The detection signal 34 is used as a melody performance start signal for the address counter 44, and as a reset signal for the note control circuit 46 and the pitch divider 48. When the note control circuit 46 and the pitch divider 48 receive the reset signal 34, the note control circuit 46 and the pitch divider 48 are reset and are restored to the initial condition. When the address counter 44 receives the detection signal 34 as the melody performance start signal, the address counter 44 specifies a memory address for predetermined note information within the melody memory 42. Addresses of the melody memory 42 which store the duration and pitch data corresponding to a predetermined melody are sequentially designated by the address counter 44. The duration and pitch data, the addresses of which are specified by the address counter 44, which are stored in a memory area of the melody memory 42 are respectively supplied to the note control circuit 46 and the pitch divider 48. The frequency dividing signal 24 which is generated from a predetermined stage of the frequency divider 14 is further supplied to the address counter 44 and note control circuit 46.

The note control circuit 46 counts the frequency dividing signal (clock signal) 24 supplied from the frequency divider 14 in response to the duration data included in the note information which is read out from the melody memory 42. In other words, the note control circuit 46 counts the duration of a note (for example, a quarter note or an eighth note) which is represented by the duration data, detects an actual period of the duration corresponding to the note, and generates an address increment designation signal 64. The address increment designation signal 64 is supplied to the address counter 44. When the address counter 44 receives the address increment designation signal 64, the address counter 44 reads out the next note information from the melody memory 42. Furthermore, the note control circuit 46 divides the period of the duration of the note into a plurality (eight, for example) of time components, the period corresponding to the duration data of the note information which is read out from the melody memory 42. A voltage signal corresponding to the time division is generated.

The pitch divider 48 receives the time reference signal 12 from the oscillation circuit 10 and divides the time reference signal in accordance with the pitch data which is included in the note information read out from the melody memory 42. A pitch signal 56 which has a frequency corresponding to the pitch data is generated by the pitch divider 48.

The voltage signal and the pitch signal which are respectively generated by the note control circuit 46 and the pitch divider 48 are supplied to an envelope circuit 60. The envelope circuit 60 produces a sound pressure signal which gradually attenuates in a stepped manner in response to the voltage signal. The sound pressure signal and the pitch signal are superposed by the envelope circuit 60. A sound signal 66 which has a pitch and duration correponding to the note information read out from the melody memory 42 and which has an envelope waveform attenuated in a stepped manner within the period corresponding to the duration of the note is produced. The sound signal 66 is supplied to a speaker circuit 68. The speaker circuit 68 converts the sound signal 66 to an audible sound.

Figure 2:
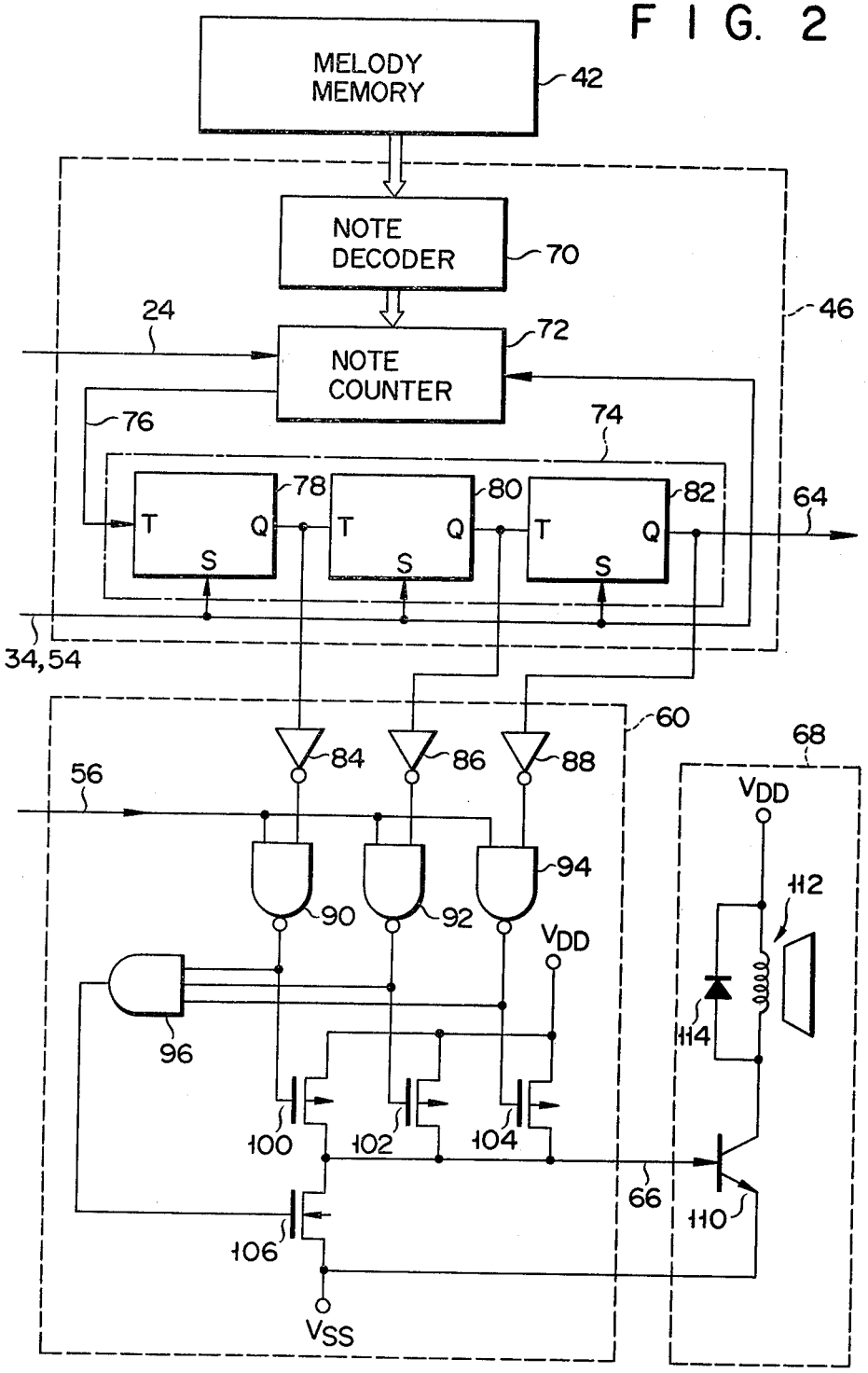
FIG. 2 is a circuit diagram illustrating a detailed internal arrangement of a note control circuit and an envelope circuit of FIG. 1.
Figures 3A, 3B, 3C, 3D:
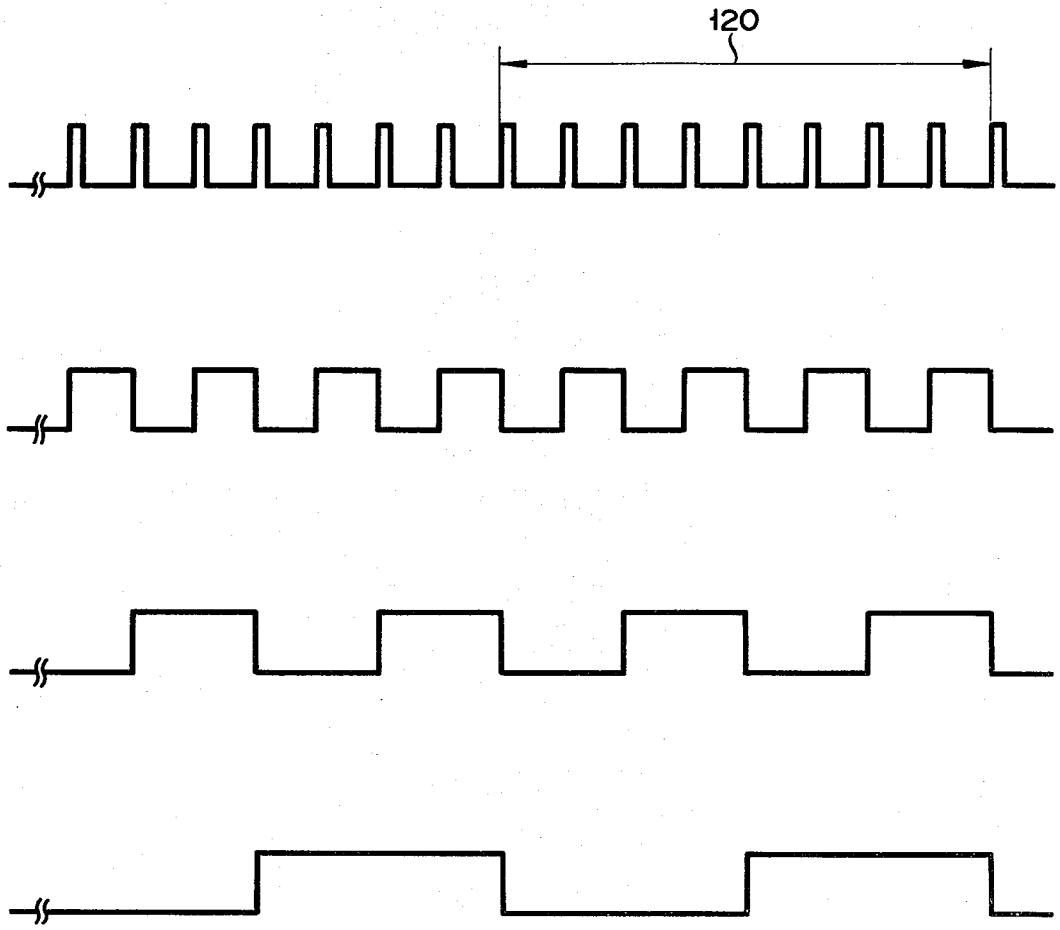
FIGS. 3A to 3D are views illustrating waveforms of signals generated at the main part of the circuit of FIG. 2.

FIG. 2 shows a detailed internal arrangement of the note control circuit 46 and the envelope circuit 60 of FIG. 1. The note control circuit 46 includes a note decoder 70, a note counter 72 and a note frequency divider 74. An input end of the note decoder 70 is connected to the melody memory 42. The note decoder 70 receives the duration data which is included in the note information read out from the melody memory 42, determines the duration of a note (for example, $\frac{1}{8}$ of one note duration ) in response to the duration data, and presets the determined period data in the note counter 72 of the next stage. The note counter 72 receives the frequency dividing signal 24 as the clock signal from a specified stage of the frequency divider 14, and counts down with the frequency dividing signal (clock signal) 24 the preset data which is preset by the note decoder 70. When the count value of the note counter 72 becomes zero, a signal 76 of logic value "1" is generated from an output end of the note counter 72. The signal 76 whose waveform is shown in FIG. 3A is supplied to the note frequency divider 74. Reference numeral 120 denotes one note duration in the figure. When the count value of the note counter 72 becomes zero, the note counter 72 is immediately preset by the note decoder 70 and repeats the count-down operation. In this embodiment, one note duration is the same as the period in which the count-down operation is repeated eight times. The preset value of the note counter 72 is predetermined by the frequency of the clock signal 24 and the actual note duration which is read out from the melody memory 42.

The note frequency divider 74 which is included in the note control circuit 46 is constituted by, for example, three binary counters 78, 80 and 82 which are connected in series. An output from the note counter 72 is divided into eighths by the binary counters 78, 80 and 82 so that the note duration of the note information read out from the melody memory 42 is divided into eighths. The voltage signal corresponding to the time division is output from output ends of the binary counters 78, 80 and 82. The waveforms of the voltage signals which are supplied from the output ends of the binary counters 78, 80 and 82 are respectively shown in FIGS. 3B, 3C and 3D. When the operation of the note frequency divider 74 as described above is completed, the address increment designation signal 64 is generated by the last binary counter 82. The address increment designation signal 64 is then transmitted to the address counter 44 (FIG. 1). The detection signal 34 generated by the comparator 32 and the seizure signal 54 generated by the switch input control circuit 26 are supplied to the note frequency divider 74.

A plurality of inverters, for example, three inverters 84, 86 and 88 in this embodiment, the number of which corresponds to that of the binary counters which constitute the note frequency divider 74, are arranged within the envelope circuit 60. Input ends of the inverters 84, 86 and 88 are respectively connected to the output ends of the binary counters 78, 80 and 82. Output ends of the inverters 84, 86 and 88 are respectively connected to first input ends of three NAND networks 90, 92 and 94. Second input ends of the NAND networks 90, 92 and 94 receive the pitch signal 56 which is generated by the pitch divider 48. Output ends of the NAND networks 90, 92 and 94 are connected to first, second and third input ends of an AND network 96. The output ends of the NAND networks 90, 92 and 94 are respectively connected to gate electrodes of first, second and third switching transistors, for example, p-channel MOSFETs 100, 102 and 104. The amplification factors of the p-channel MOSFETs 100, 102 and 104 are set in a ratio of 1:2:4. An output end of the AND network 96 is connected to a gate electrode of an off-level setting transistor, for example, an n-channel MOSFET 106, which switches in respose to an output of the AND network 96. A predetermined first power source voltage $V_{DD}$ is supplied to the source electrodes of the first to third MOSFETs 100, 102 and 104. Drain electrodes of the first to third p-channel MOSFETs 100, 102 and 104 are connected to a drain electrode of the n-channel MOSFET 106 and a base electrode of a speaker driving transistor, for example, an npn transistor 110, which is included in the speaker circuit 68. A second power source voltage $V_{SS}$ ($V_{DD}>V_{SS}$)is supplied to a source electrode of the n-channel MOSFET 106 and an emitter electrode of the npn transistor 110. A collector electrode of the npn transistor 110 is connected to one end of a speaker 112 of known type. The other end of the speaker 112 receives the first power source voltage $V_{DD}$. A noise reduction diode 114 is connected in parallel with the speaker 112.

The inverters 84, 86 and 88 invert output signals from the binary counters 78, 80 and 82 which are included in the note control circuit 46. The output signals from the inverters 84, 86 and 88 are respectively supplied to the NAND networks 90, 92 and 94. The first to third MOSFETs 100, 102 and 104 respectively operate in response to the NAND networks 90, 92 and 94. Therefore, the pitch signal 56 is selectively supplied to the first to third p-channel MOSFETs 100, 102 and 104 in every division step by the note control circuit 46 so that the first to third p-channel MOSFETs 100, 102 and 104 perform the switching operation. In response to the operation of the first to third p-channel MOSFETs 100, 102 and 104, the sound signal 66 is produced which has the same frequency as the pitch signal 56 and which has a stepped waveform which is gradually attenuated in a stepped manner for every time component divided by the note control circuit 46. In this condition, the pitch signal 56 which is supplied from the pitch divider 48 repeatedly alternates from high level to low level. When the pitch signal 56 is set at low level, the AND network 96 produces a signal of logic value "1". Therefore, the n-channel MOSFET 106 is rendered conductive so that the level of the sound signal 66 becomes substantially the same as the level of the power source voltage $V_{SS}$. The component units such as the address counter 44, the note control circuit 46, the pitch divider 48 and the envelope circuit 60 are integrated on one chip substrate.

The series circuit consisting of the npn transistor 110 and the speaker 112 of the speaker circuit 68 receives a speaker driving voltage $V_{SP}$ ($=V_{DD}$ - $V_{SS}$) across its two ends. When the sound signal 66 which is produced by the envelope circuit 60 is supplied to the npn transistor 110, a current corresponding to the sound signal 66 flows through a voice coil of the speaker 112. As a result, a sound which has a pitch and sound pressure corresponding to the sound signal 66 is produced by the speaker 112.

The mode of operation of the musical envelopeproducing device with the above arrangement according to one embodiment of the present invention will be described. When a predetermined alarm time is reached whose data is entered by the operator with the keyboard 28 and stored within the alarm memory 30, the detection signal 34 is generated by the comparator 32. In response to the detection signal 34, the address counter 44 starts operating. A duration datum which is included in the note information stored in the melody memory 42 is transmitted to the note control circuit 46. A pitch datum of the note information is transmitted to the pitch divider 48. Assume that first duration data of a sixteenth note and first pitch data having the tone name of "Do" are respectively transmitted to the note control circuit 46 and the pitch divider 48. In this case, the note control circuit 46 divides the period corresponding to the sixteenth note into eight time components and generates an output signal corresonding to the time components. The output signal consists of three voltage signals which are respectively generated by the binary counters 78, 80 and 82 arranged within the note control circuit 46. These voltage signals are supplied to the inverters 84, 86 and 88 and are inverted thereby. The inverted voltage signals are respectively supplied to the NAND networks 90, 92 and 94 which are arranged within the envelope circuit 60. The pitch signal 56 which is produced by the pitch divider 48 and which has a frequency corresponding to the frequency of the pitch data of the note information read out from the melody memory 42 is supplied to the NAND networks 90, 92 and 94. The voltage signals and the pitch signal which are supplied to the NAND networks 90, 92 and 94 and are NANDed thereby are transmitted to the first to third p-channel MOSFETs 100, 102 and 104. The p-channel MOSFETs 100, 102 and 104, the amplification factors of which are set in a ratio of 1:2:4, operate in response to the respective output signals from the NAND networks 90, 92 and 94. Therefore, a sound pressure signal is produced having a stepped musical envelope waveform which is equidistantly stepped down to a predetermined level by each of the eight time components of the note duration of the sixteenth note. The pitch frequency corresponding to the sixteenth note read out from the melody memory 42, that is, the pitch frequency of the tone name of "Do", is superposed on the sound pressure signal. In this manner, the sound signal 66 which has a stepped musical envelope waveform which sequentially changes in voltage level within the duration period of the sixteenth note and which has the same pitch frequency as the sixteenth note is produced by the envelope circuit 60. The sound signal 66 is transmitted to the speaker circuit 68 and is converted to an audible sound thereby.

When the operation of the note control circuit 46 as described above is completed, the address increment designation signal 64 is generated by the last stage binary counter 82 of the note frequency divider 74 arranged within the note control circuit 46. The address increment designation signal 64 is then supplied to the address counter 44. The address counter 44 specifies a memory address of the melody memory 42 for the next second note information in accordance with a predetermined program. Assume that the second note information consists of second duration data of a quarter note and second pitch data corresponding to the tone name of "Re". Based on the second duration data corresponding to the quarter note, in the same manner as in the sixteenth note, a stepped sound pressure signal is produced, the level of which is sequentially changed in a stepped manner in accordance with each of the eight time components of the duration of the quarter note. As described above, the pitch frequency corresponding to the frequency of the tone name of "Re" of the second pitch data is superposed by the envelope circuit 60. The sound pressure signal is transmitted to the speaker circuit 68. Therefore, an audible sound with the tone name "Re" is continuously produced within the predetermined duration by the speaker circuit 68 and is properly interrupted when the predetermined duration has elapsed in accordance with a predetermined musical envelope.

Figure 4A:
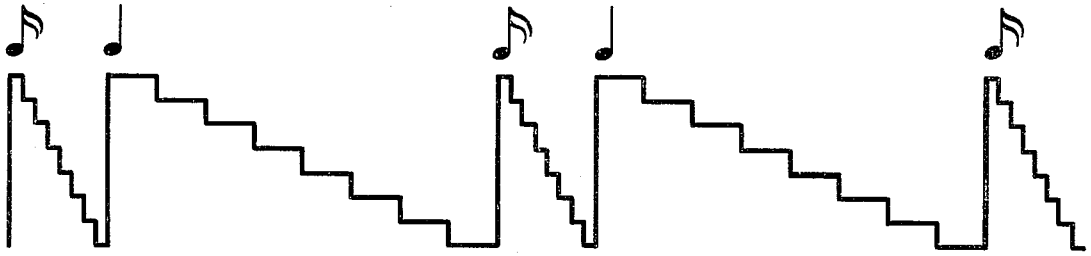
FIGS. 4A and 4B show waveforms for explaining a musical envelope characteristic of a sound signal which is output at the envelope circuit of FIGS. 1 and 2.
Figure 4B:
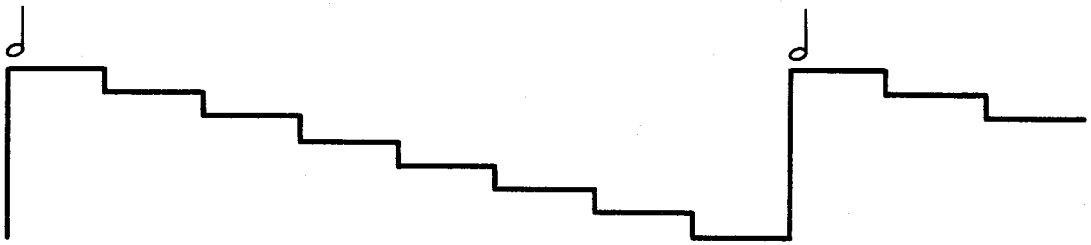

The waveform of the musical envelope of the sound signal 66 of the audible sound is shown in FIG. 4A. FIG. 4A shows a waveform in the case of performing the sixteenth and quarter notes repeatedly. As is apparent from the figure, the note duration is divided into a predetermined number of time components, for example, eight time components, corresponding to an arbirary note (sixteenth, eighth, quarter, half, whole or dotted note, etc.), independently of the duration of the note information sequentially read out from the melody memory 42 according to the present invention. The sound pressure level is sequentially attenuated in a stepped manner by each of the eight time components. Immediately before the period of the time component has elapsed, that is, immediately before the duration of the note entirely elapses, the sound pressure level becomes substantially zero. Therefore, even if a melody consisting of consecutive short notes is performed, the distinction between the notes is clear. On the other hand, even if a melody consisting of consecutive long notes is performed, each long note is continuously performed within the predetermined duration. In this manner, an optimal musical envelope in correspondence with various notes is accomplished so that natural musical performance is provided for the listener. The waveform of the musical envelope of the sound signal 66 for performing consecutive whole notes is shown in FIG. 4B for reference.

According to the present invention, an auxiliary time constant circuit constituted by capacitors and resistors is not required. The note control circuit 46 and the envelope circuit 60 are integrated on one chip so that variation in the electrical elements which are mounted on the printed circuit board and the resultant variation in the musical envelope characteristic are prevented, accomplishing a highly reliable operation.

Although the present invention has been shown and described with repect to a particular embodiment, nevertheless, various changes and modifications which are obvious to a person skilled in the art to which the present invention pertains are deemed to lie within the spirit, scope and contemplation of the present invention. For example, in the embodiment described above, the note control circuit 46 is arranged so as to divide the duration of one note into eight time components. However, the number of time components is not limited to eight. The number of time components may be changed in accordance with various requirements. Further, the envelope circuit 60 controls the envelope characteristic based on the duration data in the embodiment as described above. However, the control operation of the envelope circuit 60 is not limited to this. For example, the envelope characteristic may be controlled by the pitch data or by an arrangement in which data for controlling the envelope characteristic is stored in a special memory and the envelope characteristic is controlled by designating a specific address of the memory.

What is claimed is:

1. A musical envelope-producing device comprising:

(a) memory means for storing a plurality of note data including first musical performance data representing note pitch and second musical performance data representing note duration;

(b) read-out means for selecting and reading out the note data from said memory means;

(c) first processing means, connected to said memory means, for receiving the first musical performance data and generating a tone signal according to the first musical performance data;

(d) second processing means, connected to said memory means, for receiving the second musical performance data and dividing the note duration represented by the second musical performance data into a plurality of time components represented by division signals, said division signals comprising a plurality of signals of different periods; and (e) envelope circuit means, responsive to said tone signal and said division signals, for producing a stepped, sound pressure signal representing a stepped musical envelope waveform whose level attenuates during note duration in a stepped manner in response to said division signals, whereby said sound pressure signal and said tone signal are used to generate a sound signal.

2. A musical envelope-producing device according to claim 1, wherein said second processing means further includes means for generating an increment signal when said duration has elapsed and suppling said increment signal to said read-out means so that said read-out means sequentially reads out the selected note data from said memory means in response to the increment signal.

3. A musical envelope-producing device according to claim 1, wherein said first processing means receives a predetermined time reference signal and produces the tone signal by dividing the time reference signal in accordance with the first musical performance data read out from said memory means.

4. A musical envelope-producing device according to claim 1, wherein the number of time components selected for said second processing means is independent of the duration of the various notes stored in the note data in said memory means.

5. A musical envelope-producing device according to claim 1 wherein said envelope circuit means comprises:

(a) a plurality of NAND networks having first inputs for receiving the division signals output from said second processing means from which the attenuated, stepped pressure signals are derived, and having second inputs for receiving said tone signal, and (b) a plurality of transistors respectively connected to the outputs of said NAND networks, for performing a switching operation in response to the output of said NAND networks and providing a sound signal comprising the generated tone signal with an attenuated envelope.

6. A musical envelope-producing device according to claim 5, wherein said envelope circuit means further comprises:

(a) inverting means respectively connected to the first inputs of said NAND networks for inverting said division signals;

(b) an AND network having a plurality of inputs respectively connected to the outputs of said NAND networks, and having one output; and (c) transistor means having a first electrode connected to the output of said AND network, a second electrode connected to the commonly-connected outputs of said transistors and a third electrode connected to a voltage source whose level is lower than that of the voltage source of said transistors, for performing a switching operation between the second and third electrodes of said transistor means in response to said AND network.

7. A musical envelope-producing device according to claim 1 wherein said second processing means comprises:

(a) decoder means, connected to said memory means, for decoding the duration of each note in the second musical performance data read out from said memory means and for generating duration data, (b) counter means, connected to said decoder means, for receiving the duration data and presetting a value corresponding to the duration data for each note, said counter means counting down from the preset value to zero in response to a clock signal and generating an output signal when the preset value becomes zero, and (c) frequency dividing means, connected to said counter means, for dividing the output signals from said counter means into said plurality of time components.

8. A muscial envelope-producing device according to claim 7, wherein said frequency dividing means of said second processing means includes a predetermined number of binary dividers connected in series, the number of which is determined in accordance with the number of time components, said binary dividers having outputs comprising said plurality of signals of different periods, said outputs connected to said envelope circuit means, and said increment signal being obtained from the output of the last binary divider in the series.

9. An electronic watch which automatically plays a melody to indicate a preset time, said electronic watch comprising:

(a) an oscillation circuit for generating a time reference signal:

(b) frequency dividing means for dividing the time reference signal which is generated by said oscillation circuit;

(c) time counter means, connected to said frequency dividing means, for performing counting in accordance with a frequency dividing signal and for outputting current time data;

(d) first memory means for storing alarm time data specified by a operator;

(e) comparator means, connected to said time counter means and said first memory means, for comparing the current time data which is output by said time counter means and the alarm time data which is stored in said first memory means and for generating a predetermined detection signal when the current time data and alarm time data coincide;

(f) second memory means for storing a plurality of note data including first musical performance data representing note pitch and second musical performance data representing note duration;

(g) read-out means for selecting and reading out the note data from said memory means;

(h) first processing means, connected to said second memory means, for receiving the first musical performance data and generating a tone signal according to the first musical performance data;

(i) second processing means, connected to said second memory means, for receiving the second musical performance data and dividing the note duration represented by the second musical performance data into a plurality of time components represented by division signals;

(j) envelope circuit means, responsive to said tone signal and said division signals, for producing a stepped, sound pressure signal representing a stepped musical envelope waveform whose level attenuates during note duration in a stepped manner in response to said division signals; whereby said sound pressure signal and said tone signal are used to generate a sound signal; and (k) speaker means connected to said envelope circuit means, for receiving the sound signal and for converting the sound signal to an audible sound.

10. An electronic watch according to claim 9 wherein said envelope circuit means comprises:

(a) a plurality of NAND networks having first inputs for receiving said division signals output from said second processing means from which the attenuated, stepped pressure signals are derived, and having second inputs for receiving said tone signal, and (b) a plurality of transistors respectively connected to the outputs of said NAND networks, for performing a switching operation in response to the output of said NAND networks and providing a sound signal comprising the generated tone signal with an attenuated envelope.

* * * * *